US010274224B2

(12) United States Patent
Hansen et al.

(10) Patent No.: US 10,274,224 B2
(45) Date of Patent: Apr. 30, 2019

(54) DISCHARGE PLENUM FOR PACKAGED HVAC UNIT

(71) Applicant: Modine Manufacturing Company, Racine, WI (US)

(72) Inventors: Erik Hansen, Mt Pleasant, WI (US); Jacob Pachniak, Mt Pleasant, WI (US); Roy Turtenwald, Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 386 days.

(21) Appl. No.: 14/932,641

(22) Filed: Nov. 4, 2015

(65) Prior Publication Data

US 2017/0122619 A1 May 4, 2017

(51) Int. Cl.

| | |
|---|---|
| ***F24F 1/00*** | (2011.01) |
| ***F24F 13/24*** | (2006.01) |
| ***F24F 13/20*** | (2006.01) |
| ***F24F 1/0007*** | (2019.01) |

(52) U.S. Cl.

CPC ..... *F24F 13/24* (2013.01); *F24F 1/0007* (2013.01); *F24F 13/20* (2013.01); *F24F 2001/004* (2013.01); *F24F 2013/242* (2013.01)

(58) Field of Classification Search

USPC ..... 454/262

See application file for complete search history.

(56) References Cited

U.S. PATENT DOCUMENTS

| | | | | |
|---|---|---|---|---|
| 1,897,649 A | | 2/1933 | Good | |
| 2,704,504 A | | 3/1955 | Wilkening | |
| 2,948,210 A | | 8/1960 | Conlan | |
| 2,950,776 A | | 8/1960 | Stephens | |
| 3,091,288 A | * | 5/1963 | Williams | F24F 3/0522 165/48.1 |
| 3,507,356 A | | 4/1970 | Smith | |
| 3,642,093 A | | 2/1972 | Schach | |
| 3,811,531 A | * | 5/1974 | Forssman | F01N 1/082 181/258 |
| 4,660,676 A | | 4/1987 | Eustace | |
| 4,678,025 A | * | 7/1987 | Oberlander | F24F 1/022 165/48.1 |
| 5,332,872 A | | 7/1994 | Ewanek | |

(Continued)

OTHER PUBLICATIONS

Canadian Patent Office Action for Application No. 2,946,129 dated Dec. 1, 2017 (4 pages).

*Primary Examiner* — Gregory Huson

*Assistant Examiner* — Frances F Hamilton

(74) *Attorney, Agent, or Firm* — Michael Best & Friedrich LLP; Jeroen Valensa; Michael J. Bergnach

(57) ABSTRACT

A discharge plenum for use with a packaged HVAC unit has an outer enclosure with opposing side walls, a front wall, a rear wall, and a top wall. A planar barrier is arranged within the discharge plenum, and extends between the side walls and furthermore extends to the front wall. One air volume is arranged in a bottom portion of the discharge plenum directly below the planar barrier, and another is arranged in a top portion of the discharge plenum directly above the planar barrier, so that the planar barrier separates the two air volumes. A turning vane is provided within the discharge plenum to direct a flow of air received into the discharge plenum towards the air volume in the bottom portion.

10 Claims, 5 Drawing Sheets

(56) References Cited

U.S. PATENT DOCUMENTS

| | | | | |
|---|---|---|---|---|
| 5,426,268 | A * | 6/1995 | Yazici | F24F 7/08 181/224 |
| 5,728,980 | A | 3/1998 | Zarnick | |
| 5,983,888 | A * | 11/1999 | Anselmino | F04D 29/664 126/299 D |
| 6,095,918 | A * | 8/2000 | Arroyo | F24F 3/1607 454/188 |
| 6,192,810 | B1 | 2/2001 | Stallings et al. | |
| 6,253,873 | B1 | 7/2001 | Norres et al. | |
| 6,342,005 | B1 | 1/2002 | Daniels et al. | |
| 6,537,490 | B2 | 3/2003 | Han | |
| 6,668,970 | B1 | 12/2003 | Lee | |
| 6,719,078 | B2 * | 4/2004 | Nakamura | F02M 35/10013 180/69.22 |
| 7,980,357 | B2 * | 7/2011 | Edwards | F01D 25/30 181/264 |
| 8,251,406 | B2 * | 8/2012 | Kawano | F15D 1/04 138/39 |
| 8,944,896 | B2 * | 2/2015 | Womac | H05K 7/1425 361/690 |
| 9,402,333 | B2 * | 7/2016 | Li | F24F 13/24 |
| 2009/0020358 | A1 * | 1/2009 | Derks | F16L 55/033 181/224 |
| 2009/0133957 | A1 * | 5/2009 | Owens | E04F 17/04 181/224 |

* cited by examiner

DISCHARGE PLENUM FOR PACKAGED HVAC UNIT

BACKGROUND

Packaged HVAC units are known devices for heating, cooling, and ventilating spaces. Such units typically operate by drawing in air using an air mover housed within the packaged unit, cooling or heating and/or dehumidifying that air, and delivering it to the space. A packaged HVAC unit can be housed directly within the space to be conditioned, allowing for ease of installation. Such devices can be especially useful in high-occupancy spaces such as classrooms and the like. In general, but especially in these type of applications, reducing or minimizing the audible noise associated with the operation of HVAC equipment is desirable.

In some cases, a packaged HVAC unit can consist of a vertically oriented unit that is designed and constructed to occupy a majority of the floor-to-ceiling height of the space to be conditioned, thereby minimizing the wall length necessary to accommodate the unit. Such a design can advantageously direct the air flow through the HVAC unit in an overall upward direction, so that the conditioned air is directed from the top of the unit. In installations where ceiling ductwork is available to receive the flow of conditioned air and to distribute it through the space to be conditioned, such a packaged unit design can be particularly well-suited.

In addition to allowing for uniform air distribution, the additional flow length provided by ductwork is known to reduce the ambient noise associated with the HVAC unit's operation. Such a packaged HVAC unit typically includes one or more noise-producing components, such as, for example, the electric motor powered air mover. Audible noise produced by such components can be carried out of the packaged HVAC unit along with the flow of air. The pressure vibrations in the air are absorbed by the walls of the ductwork, thereby attenuating the audible noise and enabling quiet operation.

However, in many cases such ceiling ductwork is not available, and the air must be delivered directly into the conditioned space from the location of the packaged HVAC unit. In those cases, a discharge plenum is typically attached to the outlet of the packaged HVAC unit for that purpose, often filling the space between the top of the packaged unit and the ceiling. Vents provided in the discharge plenum allow for the flow of air from the packaged HVAC unit to be directed into the conditioned space. However, such a typical installation is not able to provide the noise attenuation that installed ductwork can provide. Thus, there is still room for improvement.

SUMMARY

According to an embodiment of the invention, a discharge plenum for use with a packaged HVAC unit includes an outer enclosure with opposing side walls, a front wall, a rear wall, and a top wall. A planar barrier is arranged within the discharge plenum, and extends between the side walls and furthermore extends to the front wall. A first air volume is arranged in a bottom portion of the discharge plenum directly below the planar barrier, and a second air volume is arranged in a top portion of the discharge plenum directly above the planar barrier, so that the planar barrier separates the first and second air volumes. Air outlet vents are in direct fluid communication with the second air volume, and are arranged in the front wall and/or the side walls. A third air volume is arranged in a rear portion of the discharge plenum in direct fluid communication with the first and second air volumes. A turning vane is provided within the discharge plenum to direct a flow of air received into the discharge plenum towards the first air volume. The turning van is spaced away from the side walls to allow for the passage of air from the first volume to the third volume in the spaces between the turning vane and the side walls.

In some embodiments, none of the outlet vents are in direct fluid communication with the third air volume. Air received into the third air volume must therefore be directed to the second air volume before being removed through the air outlet vents.

In some embodiments, the turning vane includes a vertically extending planar portion and an arcuate portion extending from the vertically extending planar portion. In some such embodiments the arcuate portion extends over an arc of approximately ninety degrees, and in some such embodiments the arcuate portion terminates adjacent to the planar barrier. Some embodiments further include a horizontally extending planar portion joined to the vertically extending planar portion at an end opposite the end where the arcuate portion joins to the vertically extending planar portion. The horizontally extending planar portion can connect the turning vane to the rear wall.

In some embodiments the turning vane is centrally located between the first and the second opposing side walls. In some especially preferable embodiments the turning vane extends over between 25% and 50% of the width of the discharge plenum.

According to some embodiments of the inventions, sound-absorbing insulation is provided on at least some of the interior-facing surfaces of the enclosure walls. In some embodiments sound-absorbing insulation is provided on at least one surface of the planar barrier.

According to another embodiment of the invention, a method of discharging air from a packaged HVAC unit includes receiving a flow of air into a discharge plenum mounted on top of the packaged HVAC unit. A turning vane arranged within the discharge plenum is used to direct the flow of air towards a front wall of the discharge plenum within a bottom region of the discharge plenum. The flow of air is transferred from the bottom region to a top region of the discharge plenum by way of a vertically extending flow channel arranged adjacent a rear wall of the discharge plenum, and is exhausted from the top region of the discharge plenum through outlet vents provided in one or more walls of the discharge plenum.

In some embodiments, the method includes directing the flow of air from the bottom region of the discharge plenum to the vertically extending flow channel through channels provided between the turning vane and the side walls of the discharge plenum. In some embodiments the flow of air is recirculated within the bottom region of the discharge plenum, and in some cases is directed against multiple surfaces of the discharge plenum in order to absorb audible noise vibrations from the flow of air.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
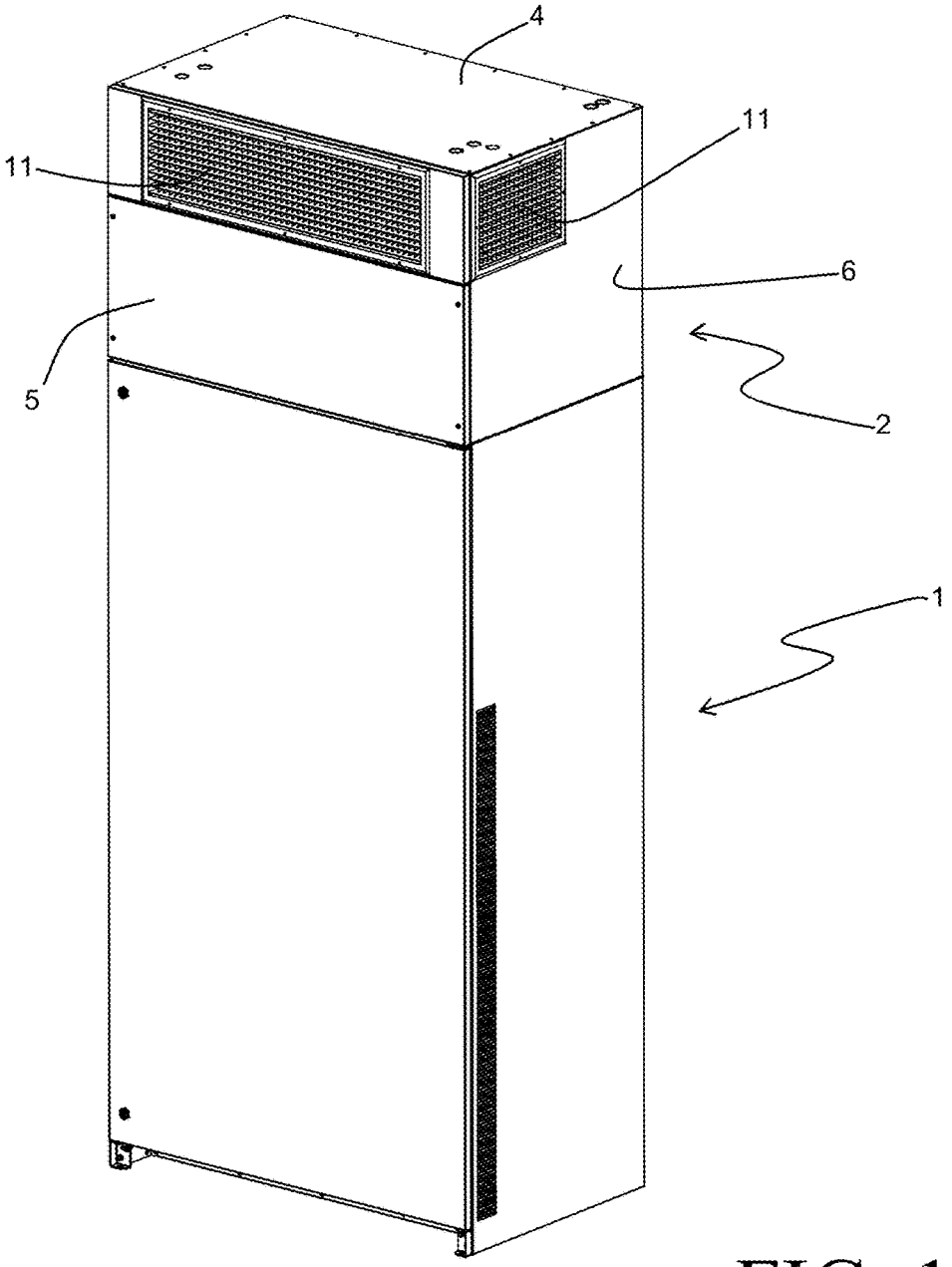
FIG. 1 is a perspective view of a packaged HVAC unit with a discharge plenum according to an embodiment of the invention.
Figure 2:
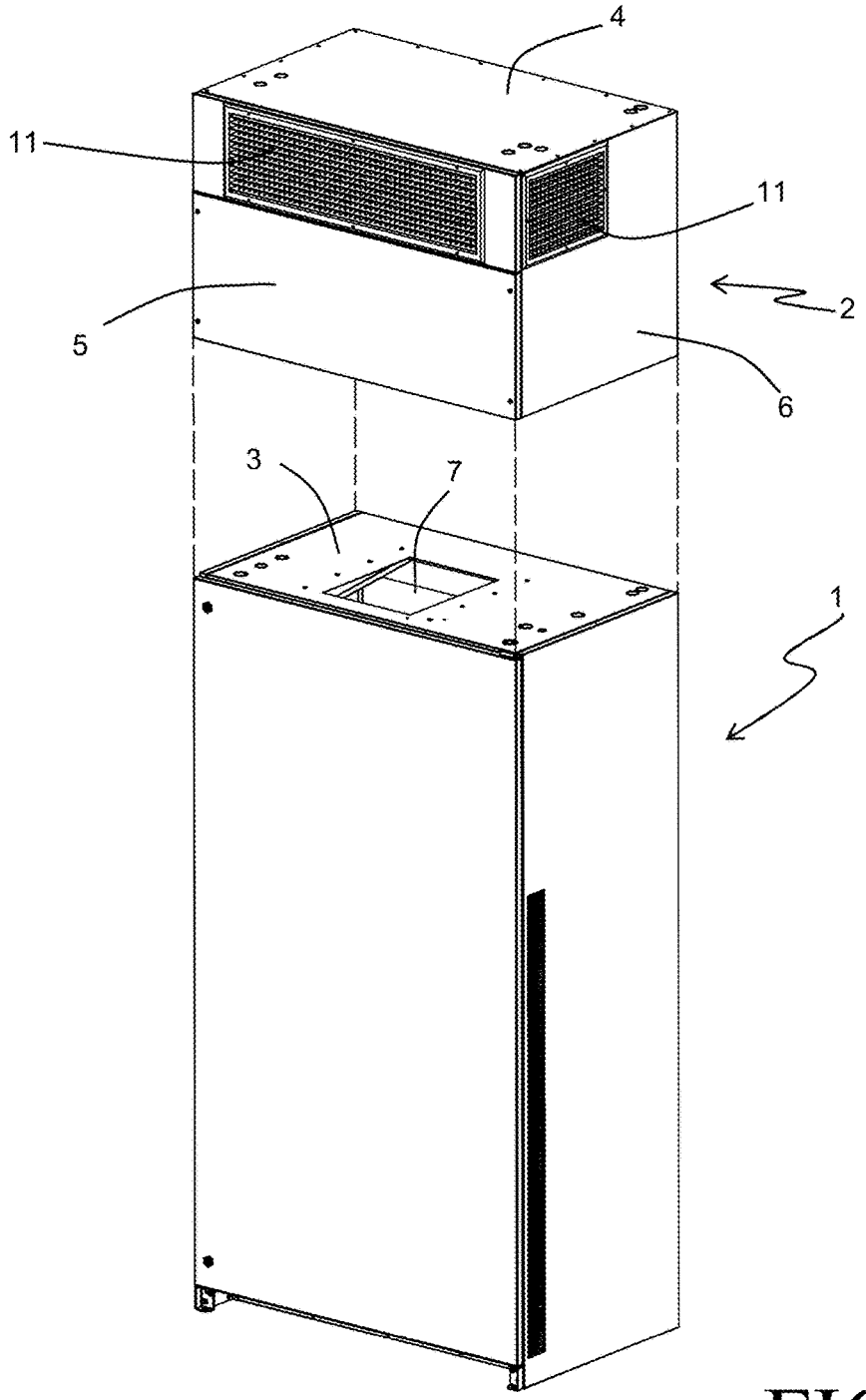
FIG. 2 is a partially exploded view of the packaged HVAC unit and discharge plenum of FIG. 1.

FIGS. 1 and 2 depict an exemplary embodiment of a discharge plenum 2 used in conjunction with a packaged HVAC unit 1, according to an embodiment of the invention. Such a packaged HVAC unit 1 can provide particular utility in environments with high occupant density such as, for example, a classroom. Air can be drawn into the packaged HVAC unit 1 from within the space being conditioned, or from an exterior environment, or both in combination. Regardless of the source, the air can be filtered and can be humidified or dehumidified, and/or heated or cooled, by components such as filters, heat exchangers, and others that are arranged within the packaged unit 1. Typically, a blower or other air mover is provided within the packaged HVAC unit 1 in order to pull air into the unit 1 and to move that air through the various components. The conditioned air is subsequently directed out of the packaged unit 1 through an exhaust aperture 7 arranged within a top surface 3 of the packaged unit 1.

The discharge plenum 2 mounts to the top surface 3 of the packaged unit 1, and can be advantageously sized to fill the space between the top surface 3 and the ceiling of the space within which the packaged unit 1 is installed. During operation of the packaged unit 1, the conditioned air is received from the exhaust aperture 7 into the discharge plenum 2 and is routed through a circuitous path within the discharge plenum 2 before being discharged through air outlet vents 11 provided on exterior surfaces of the discharge plenum 2. By traveling along this circuitous path, the flow of air is transitioned from a turbulent flow to a laminar flow prior to being exhausted through the outlet vents 11. As a result, the audible noise of the air exiting the discharge plenum can be substantially reduced.

Figure 3:
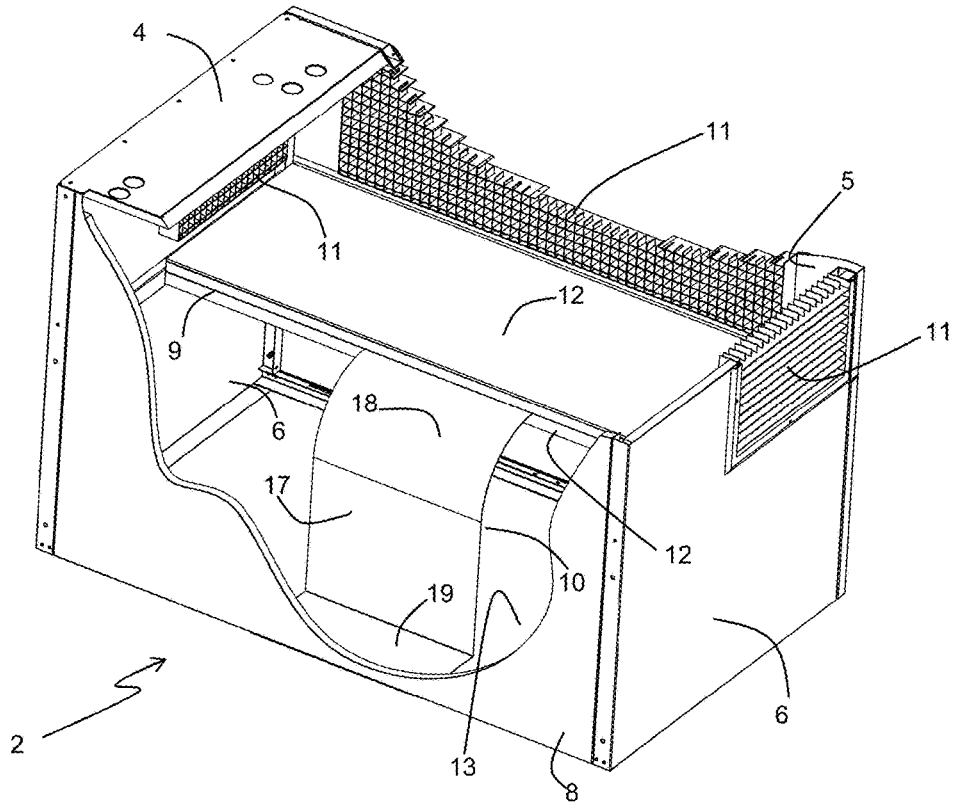
FIG. 3 is a sectioned perspective view of the discharge plenum of FIG. 1.
Figure 4:
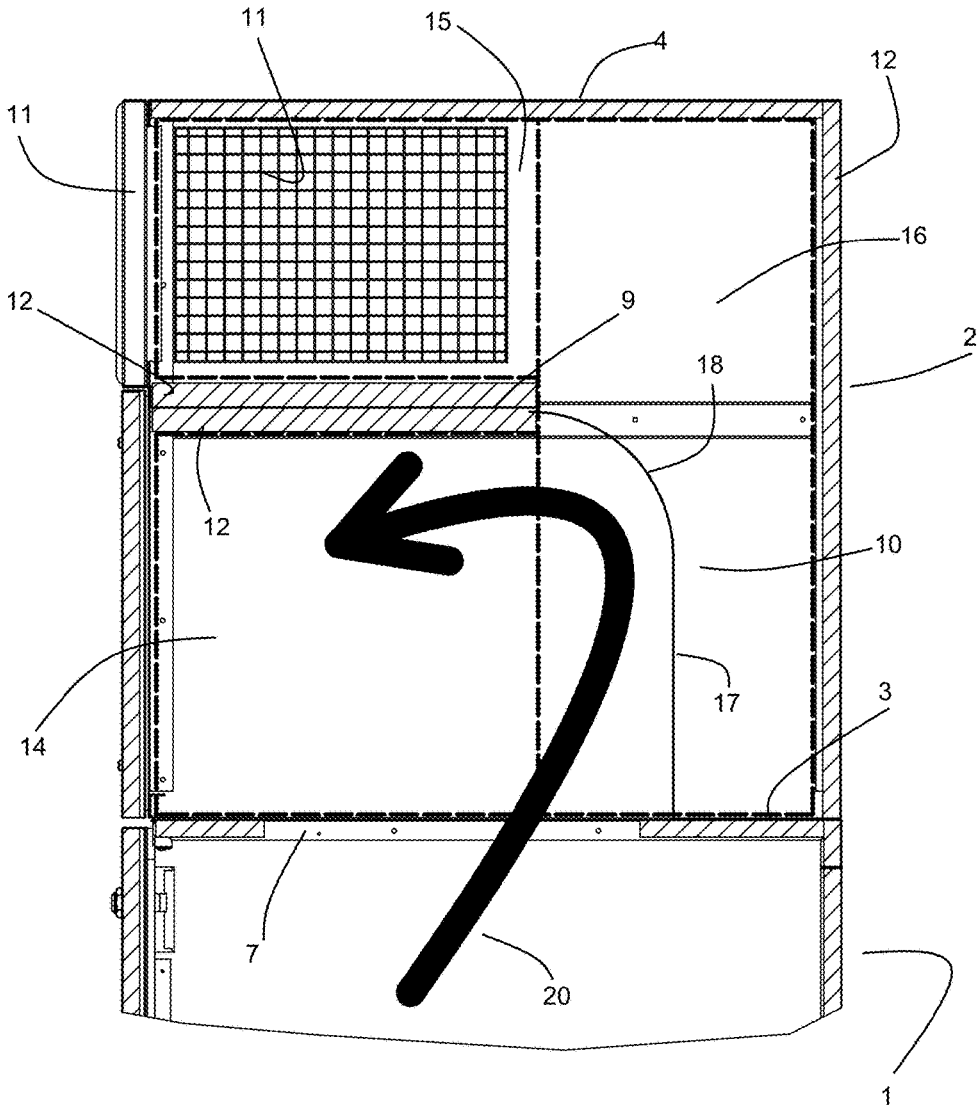
FIG. 4 is a partial cross-sectional elevation view of the packaged HVAC unit and discharge plenum of FIG. 1.
Figure 5:
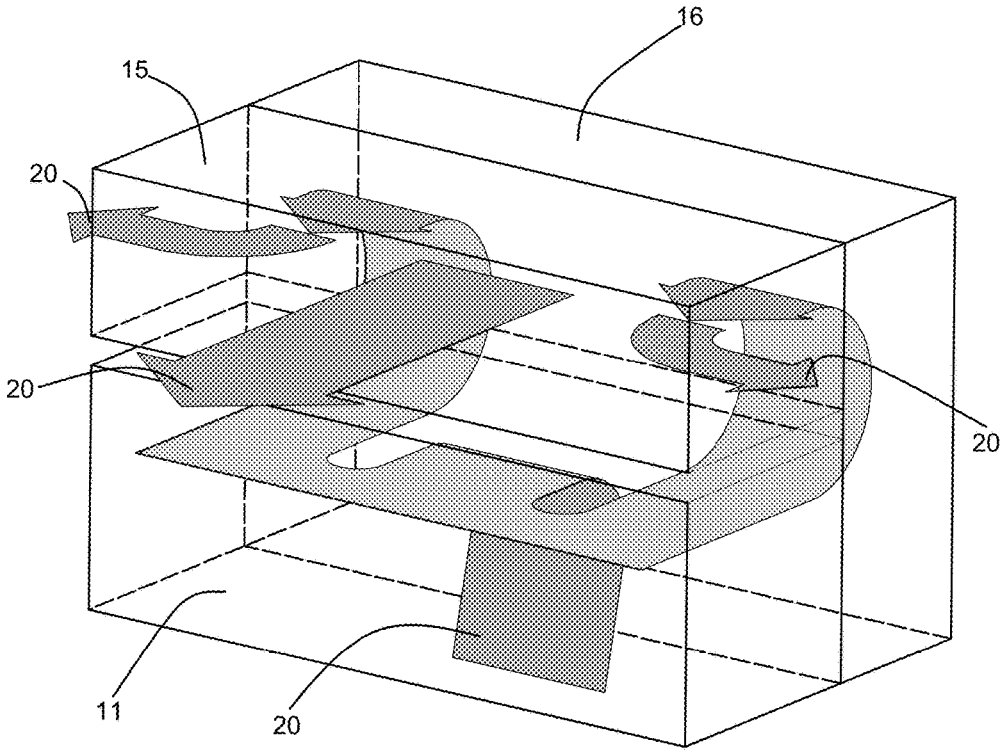
FIG. 5 is a diagrammatic view describing the movement of air through the discharge plenum of FIG. 1.

The circuitous air flow path extending through the discharge plenum 2 is depicted in FIGS. 3-5. The discharge plenum 2 is generally constructed as an open box of rectangular shape, with an outer enclosure that includes a front wall 5, a pair of opposing side walls 6, a top wall 4, and a rear wall 8. The walls 4, 5, 6, and 8 as depicted in the exemplary embodiment of FIG. 3 are constructed from formed sheet metal panels that are joined by rivets, although other types of construction could alternatively be employed. An opening 13 extends over the bottom face of the discharge plenum 2, so that the plenum 2 is mounted to the top surface 3 of the packaged HVAC unit 1 by way of bent flanges that extend from the side walls 6, the front wall 5, and the rear wall 4. As best seen in FIG. 4, sound-absorbing insulation 12 can be applied to the interior-facing surfaces of some or all of the walls 4, 5, 6, and 8 in order to reduce the transmission of audible noise from the flow of air or from the moving parts contained within the packaged unit 1.

A planar barrier 9 is provided within the interior space of the discharge plenum 2, and extends over the entirety of the inside width (i.e. the space between the opposing side walls 6). In contrast, the planar barrier extends only over a portion of the interior space of the discharge plenum in the depth direction (i.e. the direction that is normal to the front wall 5 and the rear wall 8), and is joined to the front wall 5 and each of the side walls 6. In the exemplary embodiment a layer of sound-absorbing insulation 12 is affixed to both surfaces of the planar barrier 9, although such insulation is optional and may be absent in some embodiments of the invention.

The planar barrier 9 can, by way of example, be formed from sheet metal and can includes bent flanges at one or more of the edges adjacent the front wall 5 or the side walls 6 of the enclosure of the discharge plenum 2 in order to facilitate attachment of the planar barrier 9 within the discharge plenum 2. Such attachment can be efficiently achieved through the use of mechanical fasteners such as, for example, rivets.

As best seen in FIG. 4, the total internal volume of the discharge plenum 2 can be considered to consist of three discrete volumes, the extents of which are at least partially defined by the planar barrier 9. A first air volume 14 is arranged in a bottom portion of the discharge plenum 2, and extends between the opposing side walls 6 in the width direction, from the planar barrier 9 to the bottom opening 13 in the height direction, and from the front wall 5 to the free edge of the planar barrier 9 in the depth direction. It should be understood that any sound-absorbing insulation 12, if present, is considered to be part of the wall or barrier to which it is attached for purposes of describing the bounds of the air volumes.

A second air volume 15 is arranged in a top portion of the discharge plenum 2, and extends between the opposing side walls 6 in the width direction, from the planar barrier 9 to the top wall 4 in the height direction, and from the front wall 5 to the free edge of the planar barrier 9 in the depth direction. A third air volume 16 is arranged in a rear portion of the discharge plenum 2, and extends between the opposing side walls 6 in the width direction, from the top wall 4 to the bottom opening 13 in the height direction, and from the rear wall 8 to the free edge of the planar barrier 9 in the depth direction. While the volumes 14, 15 are completely separated from one another by the planar barrier 9 so that air is prevented from moving directly between those two volumes, the volume 16 is in direct fluid communication with both the air volumes 14, 15. The volume 16 thereby defines a vertically extending flow channel to transfer air from the volume 14 to the volume 15.

A turning vane 10 is provided within the discharge plenum 2 to direct air through the volumes 14, 15, 16 along a desired route. As can be seen in FIG. 4, the turning vane 10 of the exemplary embodiment is entirely located within the volume 16, although in other embodiments portions of the turning vane 10 may extend into the volume 14 and/or the volume 15 as well. The turning vane 10 of the exemplary embodiment is formed from sheet metal, but can alternatively be produced by other methods, such as, for example, as a molded plastic part.

The turning vane 10 includes a vertically arranged planar portion 17 which is joined at one end to an arcuate portion 18 and at the other end to a horizontally arranged planar portion 19. The horizontally arranged planar portion 19 is generally co-planar with the bottom opening 13 of the discharge plenum 2, and is provided to facilitate attachment of the turning vane 2 to the enclosure of the discharge plenum 2 (specifically, to the rear wall 8. Alternative methods of securing the turning vane 10 to the discharge plenum 2 are also possible. By way of example, the free edge of the arcuate portion 18 can be secured to the planar barrier 9 in order to attach the turning vane 10 to the discharge plenum 2. Thus, the horizontally arranged planar portion 19 is optional, and need not be present in all embodiments.

The arcuate portion 18 in the exemplary embodiment extends over an arc of approximately ninety degrees. However, this swept angle can vary substantially from ninety degrees without negatively impacting the functionality of the turning vane 10, which will be described in further detail hereafter. Similarly, the orientation of the planar portion 17 need not be perfectly vertical, and it should be understood that the planar portion can still be referred to as a "vertically arranged" portion despite some variation from perfectly vertical.

The turning vane 10 extends in the width direction of the discharge plenum 2 over substantially less than the inside width of the discharge plenum (i.e. the spacing between the opposing side walls 6, inclusive of any insulation 12 on interior-facing surfaces of those side walls 6). The turning vane 10 is preferably centrally located along the width direction, and preferably extends over between 25% and 50% of the inside width dimension of the discharge plenum 2. As a result, a substantial spacing is provided between the turning vane 10 and each of the side walls 6, thereby still allowing for air movement between the volume 14 and the volume 16.

It is desirable that the extent of the turning vane 10 in the width direction is such that it overlaps entirely with the extent in the width direction of the exhaust aperture 7 of the packaged HVAC unit 1 to which the discharge plenum 2 is attached. Furthermore, it is desirable for the radius of the arcuate portion 18 to be such that the vertically arranged portion 17 is located rearward of the exhaust aperture 7. Any air exhausted into the discharge plenum 2 from the exhaust aperture 7 will thus be directed by the turning vane 10 into the air volume 14 below the planar barrier 10. The air flow path as air is exhausted into the discharge plenum 2 is depicted by the arrow 20 in FIG. 4. It should be understood that the flow of air might, upon entering the discharge plenum 2, at least partially cross into the volume 16; however, the turning vane 10 ensures that the entirety of the air flow will be directed into the volume 14.

The overall movement of air through the discharge plenum 2 is depicted in diagrammatic fashion in FIG. 5, with the general path of the air represented by the arrows 20. The air entering the discharge plenum 2 is first directed by the turning vane 10 to the internal volume 14, as previously described. Although not depicted in FIG. 5, the momentum of the air as it enters the volume 14 will cause it to recirculate within the volume 14. This recirculation results in contact between the air and the surfaces bounding the volume 14, and the presence of sound-absorbing insulation 12 on those surfaces will result in the absorption of audible noise vibrations carried along by the flow of air.

As further indicated by the arrows 20 in FIG. 5, the air will eventually move from the volume 14 to the volume 16 by way of the space between the turning vane 10 and each of the side walls 6. Once within the volume 16, the air is able to move vertically over the entire height of the discharge plenum 2, thus enabling the air to move vertically past the planar barrier 9. Subsequently, the flow of air is able to pass from the volume 16 into the volume 15 and, from there, to exit the discharge plenum 2 through the vents 11. The circulation of air through the various air volumes allows for more uniform distribution of air to the vents 11, and provides a more laminar air flow from the discharge plenum 2.

The vents 11 are preferably arranged so that they are solely in direct communication with the volume 15 and not with the volume 16 or the volume 14. In other words, the vents 11 preferably do not extend below the planar barrier 9, or further rearward than the free edge of the planar barrier 9. Such a location of the vents 11 will require that the air flow pass in succession from the volume 14 to the volume 16, and from the volume 16 to the volume 15, before exiting the discharge plenum 2. This routing of the air flow through the discharge plenum 2 serves to substantially increase the path length of the air, and provides greater attenuation of undesirable audible noise vibrations through the associated increased contact with sound-absorbing surfaces.

Experimentation by the inventors in a semi-anechoic sound chamber has revealed that the sound pressure from air exhausting out of the discharge plenum, when mounted to an operating packaged HVAC unit, is reduced by as much as 7 decibels when a discharge plenum according to the described embodiment of the invention is used in place of a standard discharge plenum.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A discharge plenum for use with a packaged HVAC unit, comprising:

an outer enclosure including first and second opposing side walls, a front wall, a rear wall, and a top wall;

a planar barrier arranged within the discharge plenum, extending between the first and second opposing side walls and extending to the front wall;

a first air volume arranged in a bottom portion of the discharge plenum directly below the planar barrier;

a second air volume arranged in a top portion of the discharge plenum directly above the planar barrier, the first and the second air volumes being separated from one another by the planar barrier;

air outlet vents in direct fluid communication with the second air volume and arranged in one or more of the front wall, the first side wall, and the second side wall;

a third air volume arranged in a rear portion of the discharge plenum and in direct fluid communication with both the first and the second air volumes; and a turning vane arranged within the discharge plenum to direct a flow of air received into the discharge plenum towards the first air volume, the turning vane being spaced away from both the first and second opposing side walls to allow for the passage of air from the first volume to the third volume in the spaces between the turning vane and the side walls.

2. The discharge plenum of claim 1, wherein none of the air outlet vents are in direct fluid communication with the third air volume, so that air received into the third air volume must be directed to the second air volume before being removed from the discharge plenum through the air outlet vents.

3. The discharge plenum of claim 1, wherein the turning vane includes a vertically extending planar portion and an arcuate portion extending from the vertically extending planar portion.

4. The discharge plenum of claim 3, wherein the arcuate portion extends over an arc of approximately ninety degrees.

5. The discharge plenum of claim 3, wherein the arcuate portion terminates adjacent to the planar barrier.

6. The discharge plenum of claim 3, wherein the turning vane further includes a horizontally extending planar portion joined to the vertically extending planar portion at an end opposite the end where the arcuate portion joins to the vertically extending planar portion, the horizontally extending planar portion connecting the turning vane to the rear wall.

7. The discharge plenum of claim 1, wherein the turning vane is centrally located between the first and the second opposing side walls.

8. The discharge plenum of claim 1, wherein the spacing between the first and second opposing side walls defines a width of the discharge plenum, wherein the turning vane extends over between 25% and 50% of the width of the discharge plenum.

9. The discharge plenum of claim 1, further comprising sound-absorbing insulation on interior-facing surface of one or more of the first and second opposing side walls, the front wall, the rear wall, and the top wall.

10. The discharge plenum of claim 1, further comprising sound-absorbing insulation on at least one surface of the planar barrier.

* * * * *